US011271316B2

(12) United States Patent
Thevenard et al.

(10) Patent No.: US 11,271,316 B2
(45) Date of Patent: Mar. 8, 2022

(54) OMNIDIRECTIONAL VOLUMETRIC ANTENNA

(75) Inventors: Julian Thevenard, Laiz (FR); Dominique Lo Hine Tong, Rennes (FR); Ali Louzir, Rennes (FR); Corinne Nicolas, La Chapelle des Fougeretz (FR); Christian Person, Saint Renan (FR); Jean-Philippe Coupez, Brest (FR)

(73) Assignee: Thomson Licensing, Cesson-Sevigne (FR)

( * ) Notice: Subject to any disclaimer, the term of this patent is extended or adjusted under 35 U.S.C. 154(b) by 3443 days.

(21) Appl. No.: 12/452,003

(22) PCT Filed: Jun. 4, 2008

(86) PCT No.: PCT/EP2008/056867
§ 371 (c)(1),
(2), (4) Date: Sep. 23, 2011

(87) PCT Pub. No.: WO2008/155219
PCT Pub. Date: Dec. 24, 2008

(65) Prior Publication Data

US 2012/0068903 A1 Mar. 22, 2012

(30) Foreign Application Priority Data

Jun. 12, 2007 (FR) ..... 0755695

(51) Int. Cl.
*H01Q 13/00* (2006.01)
*H01Q 9/28* (2006.01)
(Continued)

(52) U.S. Cl.
CPC ..... *H01Q 9/28* (2013.01); *H01Q 3/247* (2013.01); *H01Q 19/00* (2013.01); *H01Q 23/00* (2013.01)

(58) Field of Classification Search
CPC ..... H01Q 19/00; H01Q 13/00; H01Q 23/00; H01Q 3/24; H01Q 3/247; H01Q 9/28; H01Q 21/24
See application file for complete search history.

(56) References Cited

U.S. PATENT DOCUMENTS 2,556,046 A * 6/1951 Simpson ..... H01Q 13/04 343/773
2,602,894 A * 7/1952 Barrow ..... H01Q 13/04 343/773

(Continued)

FOREIGN PATENT DOCUMENTS

GB 01465658 A 2/1977
JP S 52156592 6/1977

(Continued)

OTHER PUBLICATIONS

Search Report dated Aug. 19, 2008.

*Primary Examiner* — Tho G Phan
(74) *Attorney, Agent, or Firm* — Vincent Edward Duffy

(57) ABSTRACT

The invention relates to a wide-band omnidirectional antenna including at least a first conducting member and a second conducting member having a revolution symmetry about a common revolution axis and central openings, said members being arranged opposite each other, at least one member having a progressively flaring area, characterised in that it comprises a gap between the conducting members and a central coaxial excitation line so as to achieve a three-dimensional contactless transition between the coaxial excitation line and the conducting members and members for modifying the radiation pattern in the flaring area of the diode type for selectively radiating the gap depending on the on- or off-state of said diodes.

19 Claims, 8 Drawing Sheets

Figure 3:
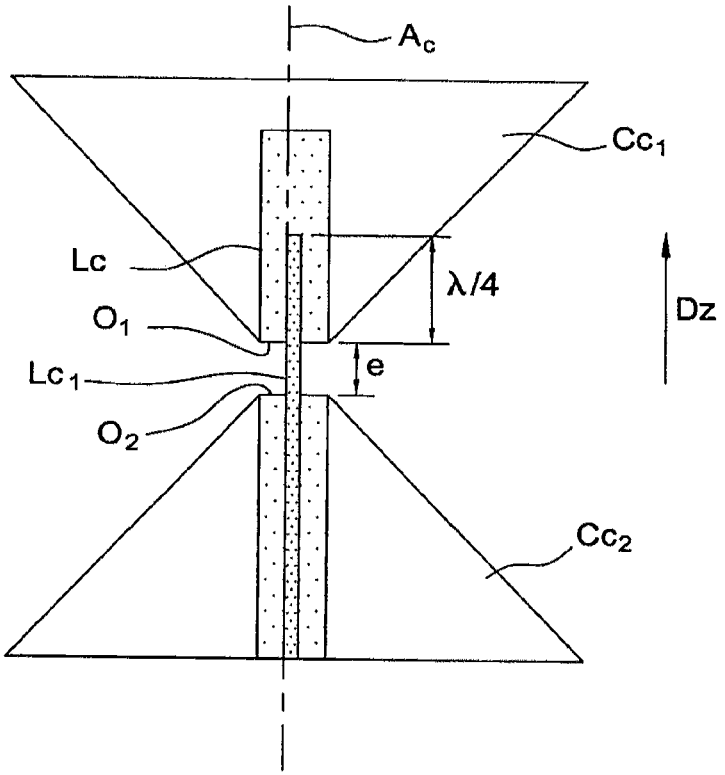

(51) Int. Cl.

| | |
|---|---|
| ***H01Q 3/24*** | (2006.01) |
| ***H01Q 23/00*** | (2006.01) |
| ***H01Q 19/00*** | (2006.01) |

(56) References Cited

U.S. PATENT DOCUMENTS

| | | | | |
|---|---|---|---|---|
| 3,373,430 | A * | 3/1968 | Croswell | H01Q 1/281 343/708 |
| 3,942,180 | A | 3/1976 | Rannou et al. | |
| 4,074,268 | A | 2/1978 | Olson | |
| 6,154,182 | A * | 11/2000 | McLean | H01Q 9/28 343/752 |
| 6,667,721 | B1 | 12/2003 | Simonds | |
| 7,002,527 | B2 * | 2/2006 | Sugawara | H01Q 3/00 343/750 |
| 7,408,521 | B2 * | 8/2008 | Smith | H01Q 9/28 343/773 |
| 7,567,154 | B2 * | 7/2009 | Elmore | H01P 3/10 333/21 R |
| 2006/0022885 | A1 | 2/2006 | Ida et al. | |
| 2006/0187134 | A1 | 8/2006 | Hoshi | |

FOREIGN PATENT DOCUMENTS

| | | | |
|---|---|---|---|
| JP | H 09153727 | A | 6/1997 |
| JP | H 11355031 | A | 12/1999 |
| JP | 2005218080 | A | 8/2005 |

* cited by examiner

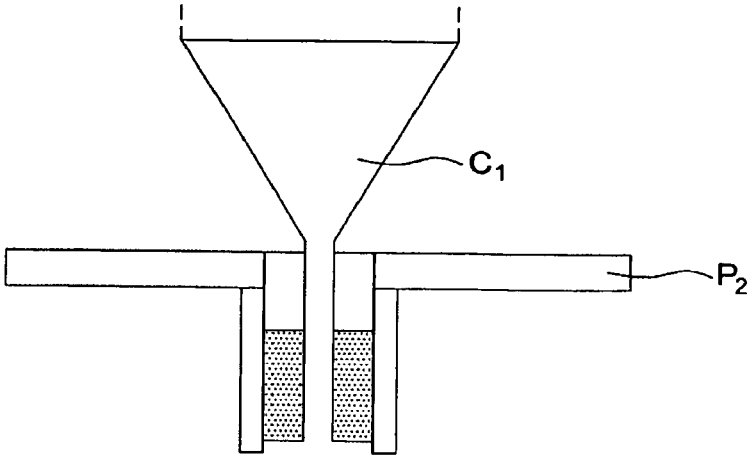
FIG.1 *Prior Art*
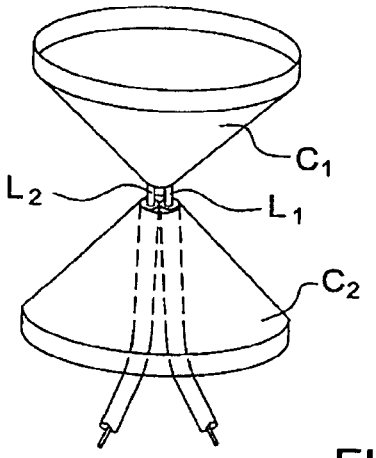
FIG.2a *Prior Art*
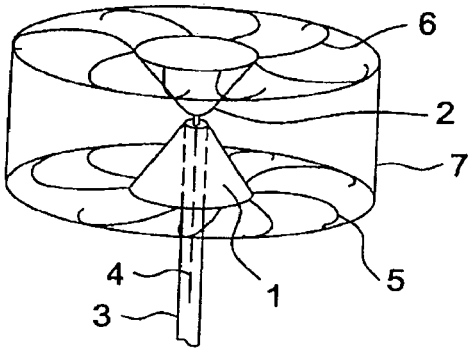
FIG.2b *Prior Art*

OMNIDIRECTIONAL VOLUMETRIC ANTENNA

This application claims the benefit, under 35 U.S.C. § 365 of International Application PCT/EP2008/056867, filed Jun. 4, 2008, which was published in accordance with PCT Article 21(2) on Dec. 24, 2008 in French and which claims the benefit of French patent application No. 0755695, filed Jun. 12, 2007.

The domain of the invention is that of omnidirectional volumetric antennas such as biconical or discone antennas, to which the addition of elements in the formation zone of the radiation pattern enables a sectoring of the angular azimuth space.

Generally a biconical antenna is obtained by the superposition of two cones placed facing each other by their pointed end, the power being from the centre of the cones. The form of the cones enables determination of a progressive tapering zone from where the wave propagates. This tapering zone can have diverse forms and can particularly offer a contour such as those used for "Vivaldi" type antennas with quasi-spherical profiles, this contour can also be reduced to a single line. The discone antenna is realized using a reflective plane on which a cone is deposed, this association presents noticeably the same characteristics as the biconical antenna in terms of efficiency.

Omnidirectional antennas are known comprising two conductor elements of type cone $C_1$ and plane $P_2$ as shown in FIG. 1, in which the central core of the coaxial cable is in contact with the upper cone while the lower plane is in contact with the exterior earth of the power supply coaxial cable.

Antennas are also known comprising two cones $C_1$ and $C_2$ with two coaxial cables $L_1$ and $L_2$ (shown in FIG. 2*a*) or as described in the published U.S. Pat. No. 2,246,090, an antenna comprising two cones 1, 2 in which it is proposed to integrate a central coaxial element 3, 4 and to connect it to parts of the cone, electrically via two conductor networks 5, 6 the whole being embedded in a material 7 (shown in FIG. 2*b*).

The omnidirectional antennas of the prior art can have a good directivity in all directions in an azimuthal plane but do not allow freedom to preferably influence the directivity in a sub-set of directions. Contact-free transition then enables facilitating the integration of the antenna.

Also known and specifically described in the patent application EP 1 460 717, is an omnidirectional antenna, in which the directivity of the antenna can be modified by electrical field variation at the level of its source of excitation, by means of switching diodes. In this context, the present invention proposes an antenna integrating a contact-free transition in three dimensions between a coaxial excitation line and two conductor elements having a rotational symmetry, corresponding to the transposition in three dimensions of a microstrip line/slot line planar transition and having radiation modifier elements of the antenna in at least one tapered part of the antenna.

More specifically the purpose of the invention is a wide band omnidirectional antenna comprising at least a first conductive element and a second conductive element having a rotational symmetry around a common rotational axis and central openings, said elements being positioned opposite one another, at least one of the elements having a progressive tapering zone characterized in that it comprises a central coaxial excitation line and a space between the two conductive elements in such a way to realize a contact-free transition in three dimensions between the coaxial excitation line and the conductive elements and modifier elements of the radiation pattern in the tapering zone.

According to a variant of the invention, one of the conductive elements is plane.

According to a variant of the invention, at least one of the conductive elements is a cone.

According to a variant of the invention, the smallest cone diameter is of higher dimension than the section of the coaxial excitation line.

According to a variant of the invention, at least one of the conductive elements is a half-sphere.

According to a variant of the invention, the modifier elements comprise diodes able to switch from a conductive state to an insulating state or MEMS type components.

According to a variant of the invention, at least one of the conductive elements comprises radial insulating sectors supporting the modifier elements.

Advantageously, at least one of the conductive elements comprising the insulating sectors is in plastic and comprises metallized parts.

Advantageously, the modifier elements are supplied by tracks printed directly onto the plastic element comprising the metallized parts.

According to a variant of the invention, the antenna also comprises metal rods connecting the two conductive elements so as to ensure an earth continuity.

According to a variant of the invention, the antenna comprises at least one entirely insulating part in which there is a conductive element presenting a progressive tapering zone.

Figure 4A:
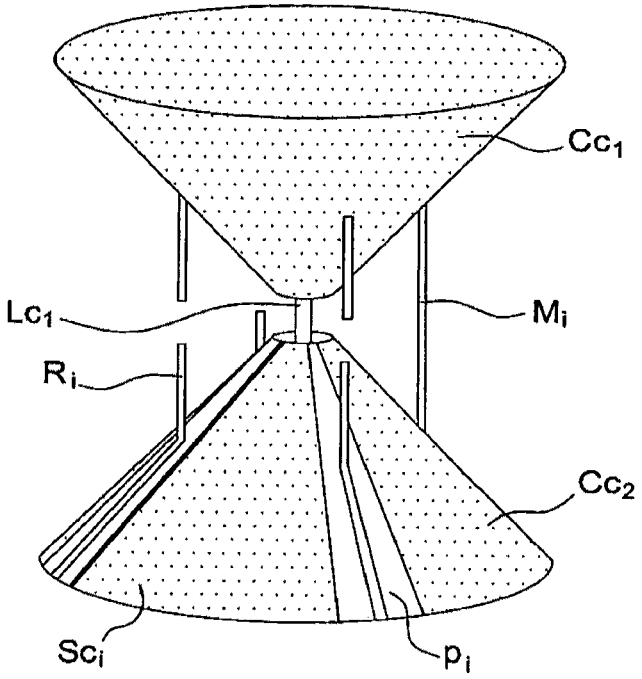
Figure 4B:
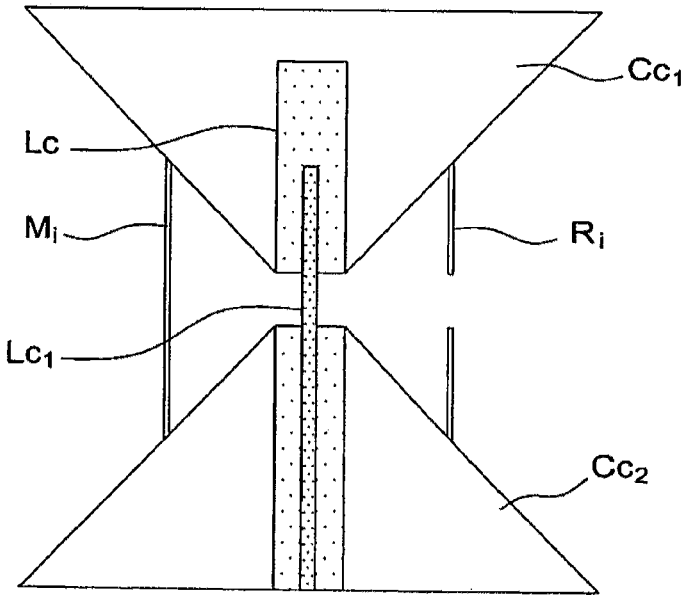
Figure 5A:
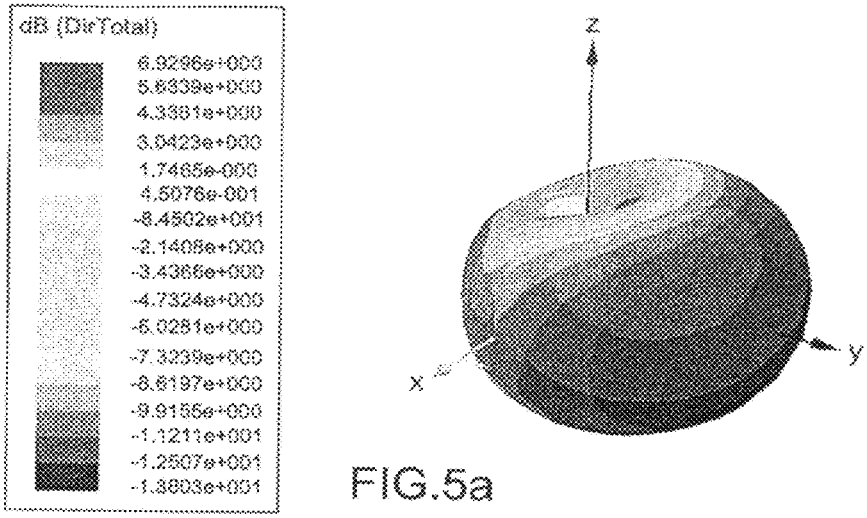
Figure 5B:
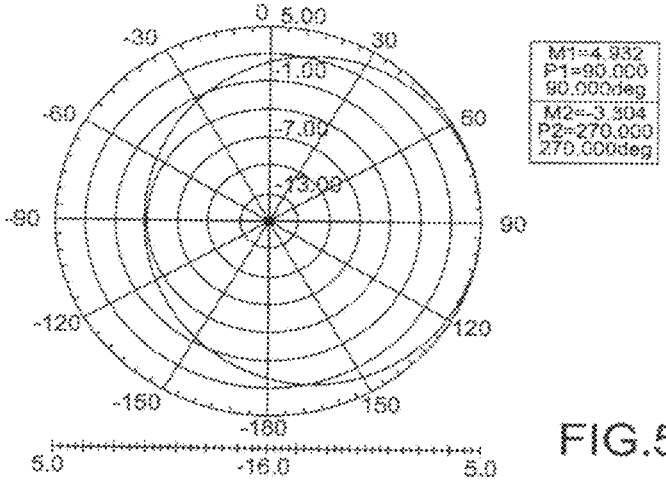
Figure 5C:
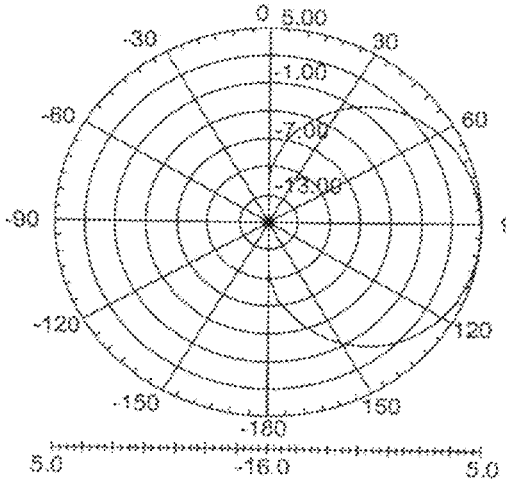
Figure 6:
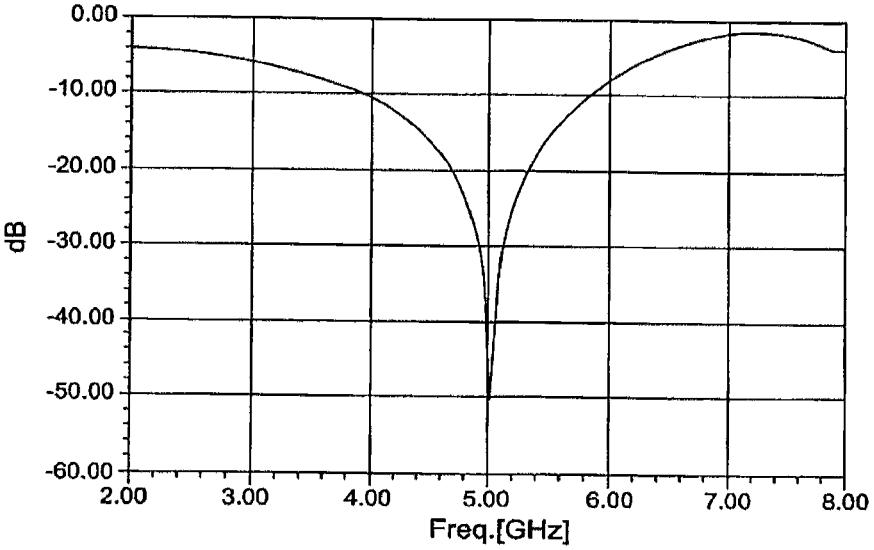
Figure 7:
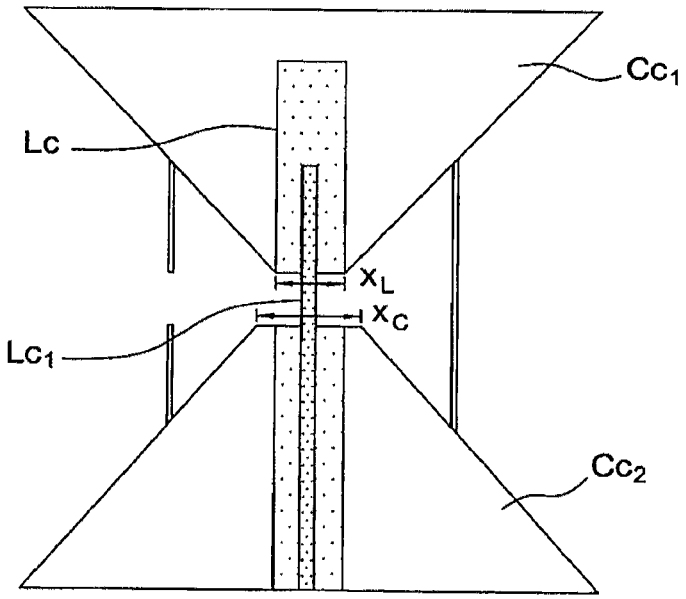
Figure 8:
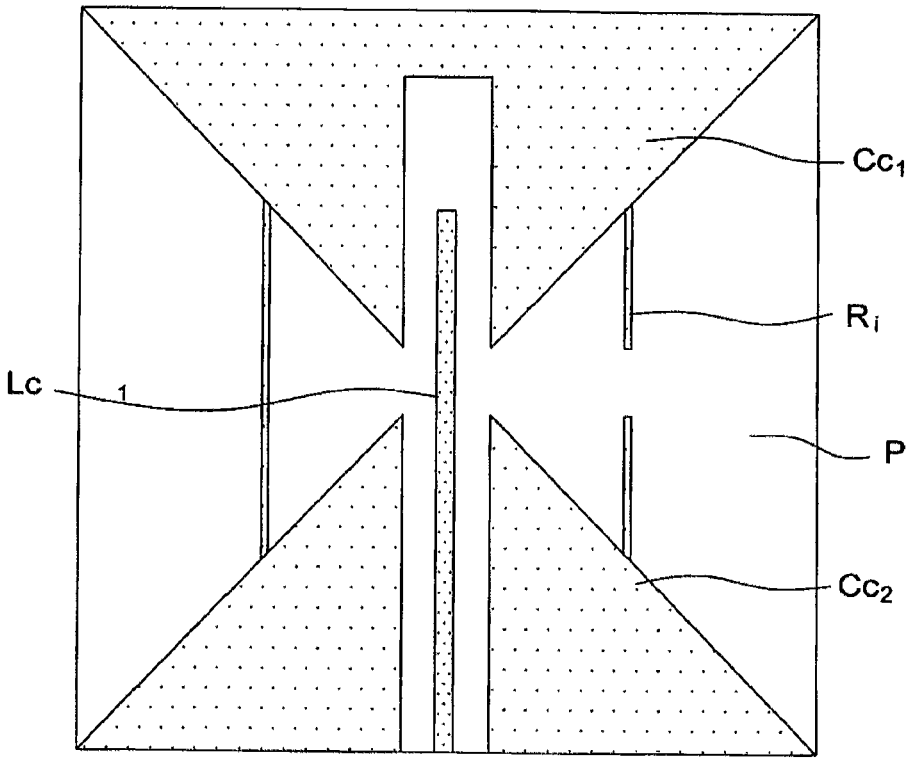

The invention will be better understood and other advantages will appear upon reading the following description, provided as a non-restrictive example and referring to the annexed drawings wherein:

FIG. 1 shows a first example of an omnidirectional antenna according to the prior art, FIGS. 2*a* and 2*b* show two other examples of omnidirectional antenna according to the prior art, FIG. 3 shows an antenna structure according to the invention comprising two conical elements and a central coaxial line, FIGS. 4*a* and 4*b* show respectively a perspective view and a cross-section view of an antenna example according to the invention and comprising the modifier elements of the radiation pattern, FIGS. 5*a*, 5*b* and 5*c* show respectively the radiation patterns of the antenna illustrated in FIGS. 4*a* and 4*b* according to a three-dimensional view, a view in the azimuth plane and a view in the elevation plane, FIG. 6 shows the losses through reflection of the antenna illustrated in 4*a* and 4*b*, FIG. 7 shows a variant in which the cones have a widening of the central opening with respect to the dimension of the central excitation line FIG. 8 shows a variant of the invention in which the conductive elements are realized in a plastic piece.

Figure 9A:
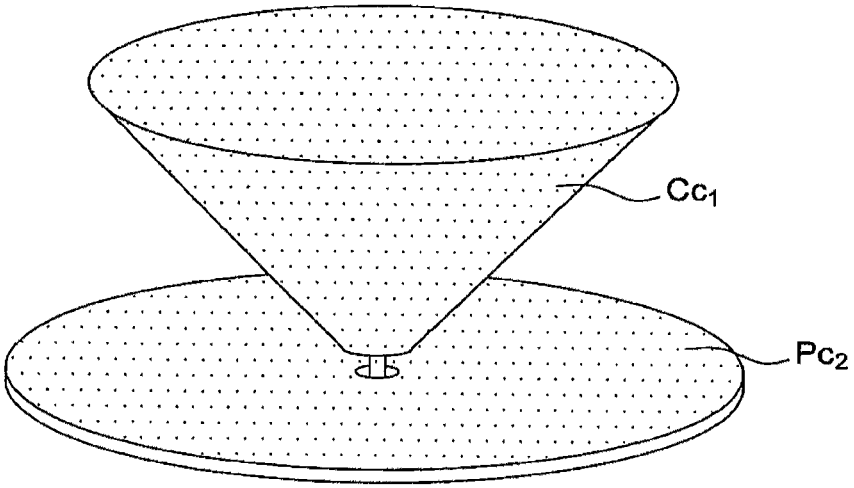
Figure 9B:
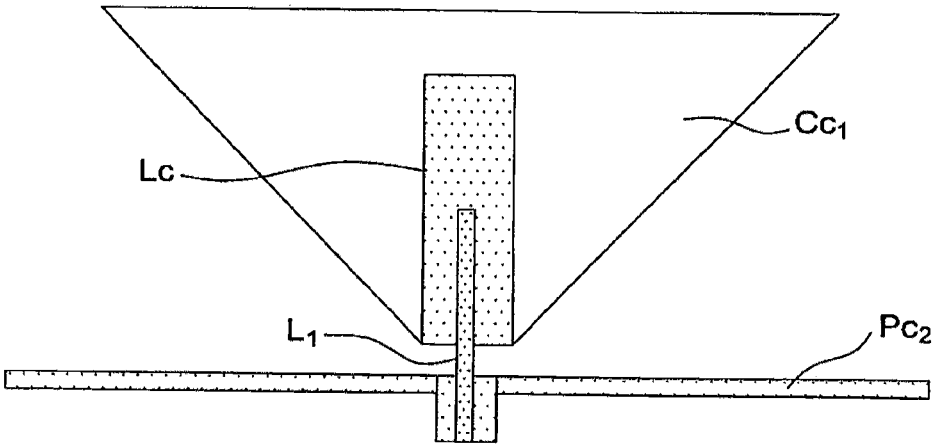
Figure 10:
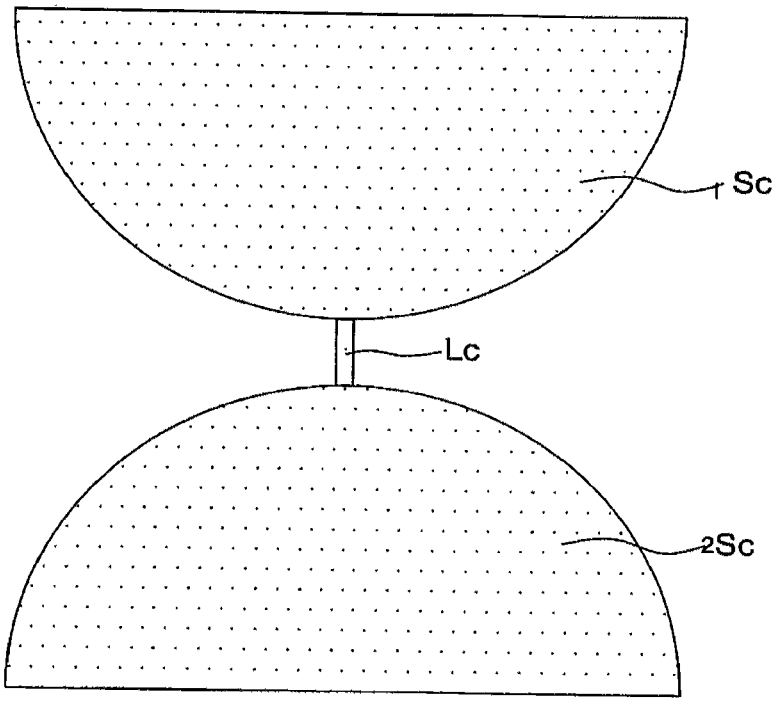

FIGS. 9*a* and 9*b* show a variant of the invention in which one of the conductive elements is plane, FIG. 10 shows an n variant of the invention in which the conductive elements are half-spheres.

In a general manner, the antenna according to the invention comprises a first element in tapered and conductive form and a second element also conductive that can also be in tapered form or in plane form. The assembly constituted by these two elements is coupled with a coaxial central excitation line. This excitation line comprises a metallic central rod that ensures the power supply function of the antenna bringing back a short-circuit at the level of the opening between the two conductive elements in order to enable the coupling between the coaxial type access and the assembly constituted by the two conductive elements. This short-circuit is realized by placing an "open circuit" at a distance of λ/4 at the extremity of the metallic rod. The height above the extremity of this central rod is also an adaptation adjustment parameter of the antenna.

FIG. 3 details an example of the structure of the omnidirectional antenna comprising more specifically a first element of conical form $C_{c1}$, a second element of conical form $C_{c2}$, and a coaxial central excitation line $L_c$. Each conductive element has a central opening $O_1$, $O_2$ enabling insertion of the excitation line among said elements and rotational symmetry around a central axis $A_c$. This excitation line comprises a central metallic rod $L_{C1}$, the penetrative length of this central rod at the level of the conductive element is typically of the order of λ/4 in order to place a short-circuit at the level of the opening of the biconical antenna. Moreover the spacing e according to the vertical direction Dz between the two conical elements enables coupling between the mode of the coaxial excitation line and the mode of the assembly constituted by the two cones.

Typically the spacing e according to the direction Dz can be in the order of 4 mm. The conical elements can have a radius of 15 mm, the structure measuring approximately 48 mm. According to the invention, the antenna also comprises radiation pattern modifier elements Ri, (director and reflector elements) in the tapering zone of the volumetric antenna as shown in FIGS. 4*a* and 4*b*.

These elements are advantageously semiconductor elements being able to pass from a insulating state to a conductive state and are inserted in the tapering zone of the volumetric antenna. They are supplied by printed tracks pi then connected to a control circuit and positioned on insulated sectors integrated into one of the conductive elements constituting the volumetric antenna. These elements represented by metallic rods on the schemas of FIGS. 6*a*, 6*b* (4 sector configuration) can be for example components such as PIN diodes, varactor diodes or MEMS type components that are connected to a control circuit placed under the structure. The modifier elements are shown diagrammatically by broken lines when they are in a blocking state. These components are disposed in such a way to be able to generate a short circuit at a distance of λg/4 (with λg=guided wavelength between the two cones) from the centre of the cone where the central metallic rod of the coaxial cable is situated in order to generate a maximum coupling and ensure the passage of the energy of the coaxial cable to the biconical antenna. These components are either in a state enabling a short circuit to be realized in order to electrically connect the earths of the two cones together and due to this to behave like a reflector element, or in a state rendering these components director elements. The control of states of these multiple component enables a sectoring of space. Their number also determines the number of sectors that can be covered by the system.

The preceding configuration was described with four sectors, advantageously the number of sectors can be varied typically it is of interest to realize eight to further modulate the radiation pattern of the antenna according to the invention.

Moreover, the conductor element comprising the insulating sectors and the conductor sectors can advantageously be a piece in plastic on which are realized the metallized sectors $S_{CI}$. The main piece in plastic can be inter-connected to the circuit by means of a mechanical system of clips or pins, it can also be attached by soldering. The earth continuity between the cones is ensured by means of the metallic rods Mi connecting the two elements $C_{C1}$ and $Cc_2$ Hence, the possibility within a single antenna block to integrate a sectoring function offers a very consequential gain in space. From a perspective of realization, use of plastic technology, that offers a way to realize the biconical or discone type antenna system, enables due to the duality and versatility of the plastic material to be able to use the plastic as an energy propagation support and consequently opens new perspectives in terms of spatial gain, weight and ease of interconnection with the rest of the communications chain.

Embodiment of an omnidirectional antenna illustrated in FIGS. 4*a* and 4*b* comprising four sectors and calibrated to be operational at 5 GHz:

This antenna comprises a main piece in three dimensions realized in "metallized plastic" technology that constitutes the "reference" antenna device support and that comprises in a "traditional" configuration two plastic cones positioned head to tail, with a central hole in order to enable power supply to the antenna that can be realized for example by means of coaxial cable type access. The height of this main piece in this example is 48 mm and the cone radius is 20 mm for operation at 5 Ghz. The space between the two cones regulated at 4 mm in this example, is an important optimization parameter, this opening plays a role in the power system of the antenna that is realized by a coupling between the coaxial cable mode and the biconical antenna mode. This power supply method belongs to a coaxial cable/slot line transition transposed in a configuration in three dimensions type power supply system.

The presence and especially the control of reflector elements enabling lighting the given sectors and in a selective manner the space, due to use of a unique central device. This is illustrated with a structure of four insulating sectors comprising such elements and using FIGS. 5*a*, 5*b* and 5*c* relative to this antenna type presenting radiation patterns at 5 GHz These patterns are shown in FIG. 5*a* (three dimensional view), 5*b* (view in azimuth plane) and 5*c* (view in elevation plane). The directivity is at 4.92 dB, the beam width at −3 dB is 90° at elevation and 160° in the azimuth plane for a forward-backward ratio less than −8 dB.

This example of structure realized to operate at 5 GHz, present typically losses due to reflection shown in FIG. 6.

According to a variant of the invention shown in FIG. 7, the omnidirectional antenna has a widening of the small diameter of cone $x_c$ with respect to the dimensions of the exterior cylinder of the power supply coaxial cable $x_L$ and more specifically with respect to the empty cylindrical zone constituting the external wall of the coaxial cable. This variant is of interest due to a simpler manufacturing process taking in account specifically of the moulding restrictions when a piece in a plastic material is used.

According to a variant of the invention, the omnidirectional antenna comprises pieces no longer hollowed described in the variants previously but pieces constituted of "solid" plastic, enabling the mechanical hold of said antenna to be reinforced. FIG. 8 shows this configuration. The conductive elements $C_{c1}$ and Cc2 are then realized inside said plastic piece P.

According to a variant of the invention, the antenna is a discone antenna having reduced overall dimensions due to one of the conductive elements that is plane with respect to the first conductor element. As shown in FIGS. 9*a* and 9*b*, the antenna comprises an upper cone metallized on the interior $C_{c1}$, a reflector earth plane $P_{C2}$ with an access to the coaxial cable $L_c$ and an opening between the cone and the reflector earth plane According to a variant of the invention shown in FIG. 10, the conductive pieces comprise a tapering zone containing such as those encountered for "Vivaldi" type antennas with quasi spherical profiles and thus constituted of two half-spheres $S_{c1}$ and $S_{c2}$ coupled to the coaxial excitation line $L_c$.

The invention claimed is:

1. Wide band omnidirectional antenna comprising at least a first conductor element and a second conductor element having a rotational symmetry around a common rotational axis and central openings, said conductor or elements being positioned facing each other, at least one of the conductor elements having a progressive tapering zone wherein the wide band omnidirectional antenna comprises:

a central coaxial excitation line and a space between the two conductor elements, the central openings and the space between the two conductor elements forming a contact free transition in three dimensions between the coaxial excitation line and the conductor elements, and radiation pattern modifier elements in the tapering zone, wherein at least one of the conductor elements comprises at least one radial insulating sector formed in plastic, the plastic including metallized parts.

2. Wide band omnidirectional antenna according to claim 1, wherein one of the conductor elements is a plane.

3. Wide band omnidirectional antenna according to claim 1, wherein at least one of the conductor elements is a cone.

4. Wide band omnidirectional antenna according to claim 3, wherein the smallest diameter of the cone is of bigger dimension than the section of the coaxial excitation line.

5. Wide band omnidirectional antenna according to claim 1, wherein at least one of the conductor elements is a half-sphere.

6. Wide band omnidirectional antenna according to claim 1, wherein the modifier elements comprise at least one of a diode capable of switching from a conducting state to an insulating state and a micro electromechanical system (MEMS) type component.

7. Wide band omnidirectional antenna according to claim 1, wherein the at least one radial insulating sector supports the modifier elements.

8. Wide band omnidirectional antenna according to claim 1, wherein the modifier elements are supplied by a metallized track printed directly on the plastic.

9. Wide band omnidirectional antenna according to claim 1 comprising metal rods connecting the two conductor elements so as to assure an earth continuity.

10. Wide band omnidirectional antenna according to claim 1, comprising at least one insulating plane piece, wherein the at least one of the conductor elements having a progressive tapering zone is metallized inside the at least one insulating plane piece.

11. An antenna, comprising:

a first conductor element having a rotational symmetry around a common axis and also having a central opening around the common axis, the first conductor element having a progressing tapering zone;

a second conductor element being positioned facing the first conductor element and having a rotational symmetry around the common axis and also having a central opening around the common axis, the second conductor element being spaced from the first conductor element;

a coaxial excitation line that passes through the central opening of the second conductor and the central opening of the first conductor; and at least one radiation pattern modifier element located in the tapering zone of the first conductive element; and at least one metal rod connecting the first conductor element to the second conductor element so as to assure an earth continuity.

12. The antenna according to claim 11, wherein the first conductor element is a cone.

13. The antenna according to claim 12, wherein the smallest diameter of the central opening of the first conductor element is larger than the largest diameter of the coaxial excitation line.

14. The antenna according to claim 11, wherein the at least one modifier element comprises at least one of a diode capable of switching from a conducting state to an insulating state and a micro electromechanical system (MEMS) type component.

15. The antenna according to claim 11, comprising at least one insulating plane piece, wherein the at least one of the conductor elements having a progressive tapering zone is metallized inside the insulating plane piece.

16. An antenna, comprising:

a first conductor element having a rotational symmetry around a common axis and also having a central opening around the common axis, the first conductor element having a progressing tapering zone;

a second conductor element being positioned facing the first conductor element and having a rotational symmetry around the common axis and also having a central opening around the common axis, the second conductor element being spaced a distance from the first conductor element;

a coaxial excitation line that passes through the central opening of the second conductor and the central opening of the first conductor; and at least one radiation pattern modifier element located in the tapering zone of the first conductive element;

wherein the first conductor element is formed using metallized plastic and wherein the modifier elements are supplied by a metallized track printed directly on the plastic.

17. The antenna according to claim 16, wherein the first conductor element is a cone.

18. The antenna according to claim 17, wherein the smallest diameter of the central opening of the first conductor element is larger than the largest diameter of the coaxial excitation line.

19. The antenna according to claim 16, wherein the first conductor element includes at least one radial insulating sector formed in the metallized plastic.

* * * * *